US006147577A

United States Patent [19]

Cavey

[11] Patent Number: 6,147,577

[45] Date of Patent: Nov. 14, 2000

[54] TUNABLE CERAMIC FILTERS

[75] Inventor: William Weldon Cavey, Salisbury, Md.

[73] Assignee: K&L Microwave, Inc., Salisbury, Md.

[21] Appl. No.: 09/007,831

[22] Filed: Jan. 15, 1998

[51] Int. Cl.[7] ..... H01P 1/20; H01P 1/208; H01P 7/10

[52] U.S. Cl. ..... 333/209; 333/219.1; 333/232; 333/235

[58] Field of Search ..... 333/202, 219.1, 333/235, 232, 233, 231, 208, 209

[56] References Cited

U.S. PATENT DOCUMENTS

| | | | |
|---|---|---|---|
| 4,385,279 | 5/1983 | Meador | 333/235 |
| 4,459,570 | 7/1984 | Delabelle et al. | 333/235 X |
| 4,565,979 | 1/1986 | Fiedziuszko | 333/235 X |
| 4,692,723 | 9/1987 | Fiedziuszko et al. | 333/202 |
| 4,692,724 | 9/1987 | Harris | 333/202 |
| 4,692,727 | 9/1987 | Wakino et al. | 333/219.1 |
| 4,694,260 | 9/1987 | Argintaru et al. | 333/235 X |
| 4,728,913 | 3/1988 | Ishikawa et al. | 333/235 |
| 5,235,294 | 8/1993 | Ishikawa et al. | 333/235 X |
| 5,578,969 | 11/1996 | Kain | 331/117 D X |
| 5,712,606 | 1/1998 | Sarkka | 333/235 X |
| 5,739,731 | 4/1998 | Hicks et al. | 333/231 X |
| 5,859,576 | 1/1999 | Winandy | 333/235 X |

FOREIGN PATENT DOCUMENTS

| | | | |
|---|---|---|---|
| 68919 | 1/1983 | European Pat. Off. | 333/235 |
| 492304 | 7/1992 | European Pat. Off. | 333/235 |
| 62-166602 | 7/1987 | Japan . | |
| 4-162802 | 6/1992 | Japan | 333/235 |
| 5-136614 | 6/1993 | Japan | 333/235 |
| 6-6120 | 1/1994 | Japan | 333/235 |
| 6-61713 | 3/1994 | Japan | 333/219.1 |
| 1259370 | 9/1986 | U.S.S.R. | 333/202 |

*Primary Examiner*—Robert Pascal
*Assistant Examiner*—Barbara Summons
*Attorney, Agent, or Firm*—Banner & Witcoff, Ltd.

[57] ABSTRACT

The present invention provides improved tunable filters that may provide more accurate tuning and a substantially greater tuning range as compared with conventional filters. Filters according to one or more aspects of the present invention may include improved tuning mechanisms, may include a CPU and a memory, wherein the CPU controls the tuning mechanism to tune to different frequencies responsive to a plurality of predefined filter characteristics stored in the memory. Filters according to one or more aspects of the present invention may further include two opposed ceramic pucks of approximately equal size, thereby providing a substantially larger tuning range than where the upper puck is simply a dielectric disk of a substantially different size. Further, the two opposed ceramic puck may be moved relative to each other in a non-rotational manner, thus reducing undesirable variations in the tuning of the filter.

21 Claims, 7 Drawing Sheets

| .08% | .06% | .07% | .08% - CONSTANT% BW |
|---|---|---|---|
| 5MHz | 4.8MHz | 5MHz | 5.1 MHz - CONSTANT MHz |

TUNABLE CERAMIC FILTERS

BACKGROUND OF THE INVENTION

This invention relates to filters and, in particular, to systems and methods for use in implementing tunable ceramic filters in wireless communication systems.

Conventional constant percent bandpass filters are typically limited to around 2% and, at most, for some frequencies around 1%. However, these filters are inapplicable for certain applications where the percent of bandwidth is required to be less than 1%, such as less than 0.1% and more preferably less than around 0.08% as shown in FIG. 7. Although it may be possible to tune a conventional percent bandpass filter to have a narrow 3 db bandwidth, the insertion loss becomes higher than an acceptable level such as 3 db. For example, if a conventional constant percent bandpass filter is tuned to have less than 0.1% 3 db bandwidth, the insertion loss may be as high as 6 db or more. Accordingly, a new filter design is required for certain applications such as cellular base station testing applications and other suitable applications.

With reference to FIG. 9, an example of a conventional air wave guide tunable filter 300 is shown. The air wave guide tunable filter 300 may include a plurality of waveguide cavities 302 each having a capacitive tuning plunger 308 interconnected via a series of gears 301 and a knob 302 for turning the gears 301. The plunger 308 is a double helical metal plunger providing an RF short in the cavity 302 which makes the waveguide cavity appear smaller as the plunger is turned down into the cavity. Thus, it appears to the RF signal as if the cavity ceiling was made shorter. The cavities are connected at the outside via an input connector 304 and an output connector 305. Each of the cavities may also include a fine tuning adjustment screw 306. The airwave guide tunable filters 300 are capable of having small percentage 3 db bandwidth filters, but are not easily scalable to low frequencies. For example, a three-cavity air wave guide filter for a one gigahertz signal may be required to have, for example, a plurality of nine inch cavities such as three nine inch cavities connected in series. Accordingly, these filters are not desirable in that they are large, bulky, and expensive to manufacture. The larger nine inch plungers are problematic in that they must be machined to very high tolerances to provide the correct RF short, and thus the larger plunger sizes are problematic to machine at these close tolerances. Referring to FIGS. 10–11, another type of conventional tunable filter is termed an "air variable capacitor tunable filter" or air variable capacitance tuner 200. The air variable capacitance tuner 200 includes a single resonator 204 in a cavity 202 with a capacitive plate 201 that may be adjusted to have a variable distance from the resonator 204. A capacitor plate may fit into a slot 203 in the resonator 204 and be adjusted to either be closer to or further away from the resonator 204. The variable capacitance tuners 200 have poor insertion loss when tuned to a narrow band 3 db bandwidth, and are therefore undesirable for some applications.

Waveguide cavity filters may be of a fixed configuration or of a tunable configuration. FIG. 8 illustrates a conventional dielectric loaded wave guide cavity that may be tuned to a higher frequency by moving the metal plate 330 lower in the cavity and closer to the ceramic puck 331. The problem with tuning the cavity of FIG. 8 is that as the metal disk is lowered closer and closer to the ceramic puck, to produce a higher resonant frequency, the Q of the cavity decreases substantially. Although the Q does not effect the 3 db bandwidth which is still tunable, the reduction in the Q has a substantial impact on the insertion loss of the wave guide filter.

An alternative tunable filter is shown in FIG. 12, where the ceramic puck 331 may be tuned by lowering a dielectric disk 332 closer to the puck. The lowering of the dielectric disk lowers the frequency of the wave guide cavity. The problem with tuning the cavity of FIG. 12 is that as the dielectric disk 332 is lowered closer and closer to the ceramic puck 331 in order to produce a lower resonant frequency, the Q of the cavity decreases substantially. The reduction in the Q has a substantial impact on the insertion loss of the wave guide filter. Conventionally, the dielectric disks are used for fine tuning and not for severely altering the center frequency of the bandpass filter over a wide range.

A problem arises with conventional tunable waveguide cavity filters in that none of these filters provides a suitable configuration which allows severely altering the center frequency of a bandpass filter over a wide range while still maintaining an acceptable insertion loss.

SUMMARY OF THE INVENTION

Aspects of the present invention include achieving a narrow bandpass filter having a constant percent bandpass characteristics across a wide frequency range. The constant percent bandwidth characteristics are that the bandpass filter maintains a relatively constant percentage of the center frequency of the bandpass filter over a range which may extend up to 2 gigahertz or even up to 15 gigahertz or more. The upper range of the bandpass filter is, of course, limited by the type of ceramics utilized in the filter. One of the objects of the improved filter design was to maintain an insertion loss that is reasonable with respect to the bandpass characteristics such as 1.8 db and up to around 3.0 db. In some embodiments of the present invention, the filter may be configured as a constant bandwidth filter which maintains a constant bandwidth (e.g., 3.0 db bandwidth) regardless of the frequency range of the filter. In other embodiments, the present invention may be utilized to construct a constant percent of center frequency bandpass filter (i.e., a constant percent bandpass filter) over a large frequency range.

In one aspect of the present invention, a tunable bandpass filter is made by including a plurality of waveguide cavities having two opposed ceramic resonators which are moveably mounted with respect to each other.

In a second aspect of the present invention, a plurality of tunable resonant waveguide cavities are formed, each having two opposed resonators which are moveably mounted with respect to each other.

In a third aspect of the present invention, a plurality of stepping motors are respectively coupled to a plurality of resonant cavities, each stepping motor for moving a first ceramic resonator relative to a second ceramic resonator in each of the resonant cavities.

Alternate aspects of the invention include one or more of the devices, elements, and/or steps described herein in any combination or subcombination. It should be clear that the claims may recite or be amended to recite any of these combinations or subcombinations as an invention without limitation to the examples in the specification.

DETAILED DESCRIPTION OF THE PREFERRED EMBODIMENTS

Figure 1:
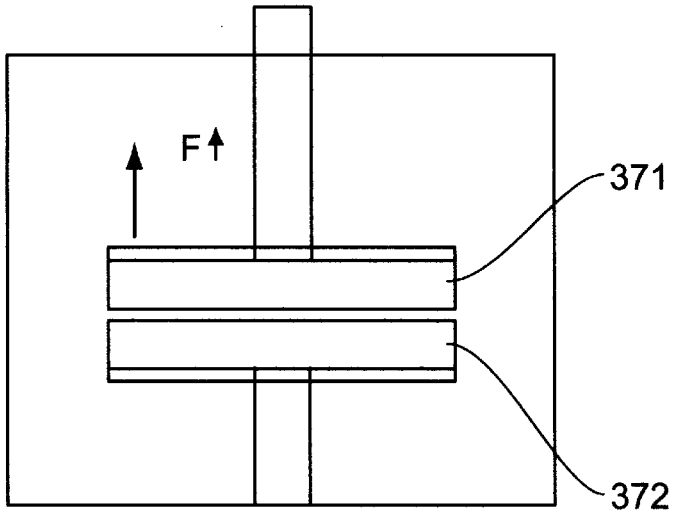
FIG. 1 shows a side view of one embodiment of one or more aspects of the present invention.
Figure 12:
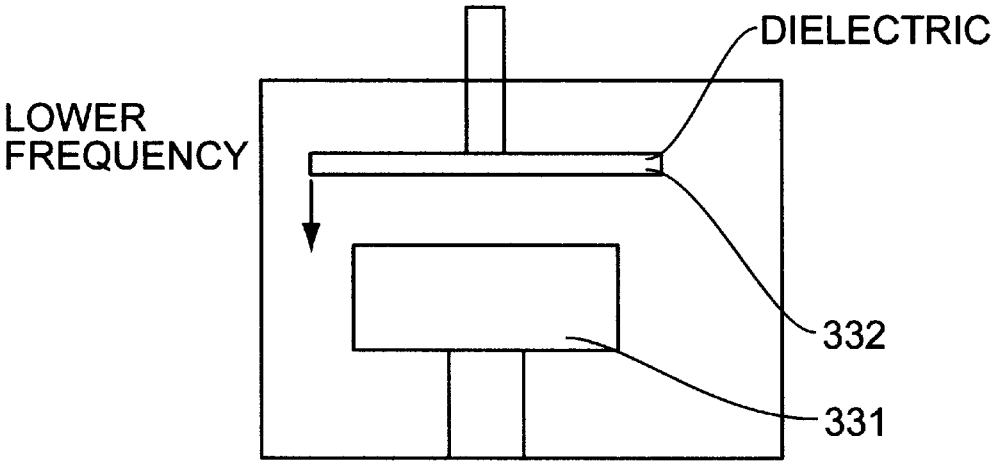
FIG. 12 PRIOR ART
FIG. 12 illustrates a conventional tunable filter.

Referring to FIG. 1, it was found that the use of two pucks of approximately equal size in a waveguide cavity provides a substantially larger tuning range than where the upper puck is simply a dielectric disk of a substantially different size (e.g., as shown in FIG. 12) or a metal disk (e.g., as shown in FIGS. 8–11). Thus, it was found that for tunable filters, the use of two opposed resonators (preferably of approximately equal size) provides significantly greater tuning range than conventional tunable filters. Again with reference to FIG. 1, as the two pucks are separated by a greater distance, the frequency to which the bandpass filter is tuned increases.

Figure 2:
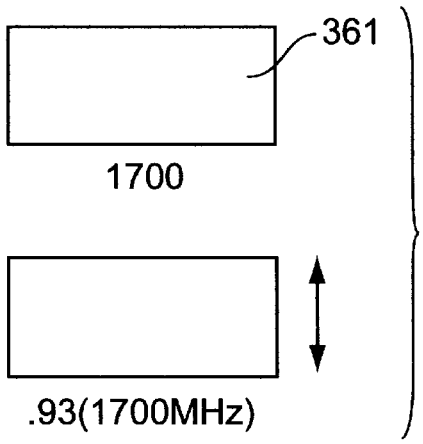
FIG. 2 shows two pucks according to one or more aspects of the present invention.
Figure 8:
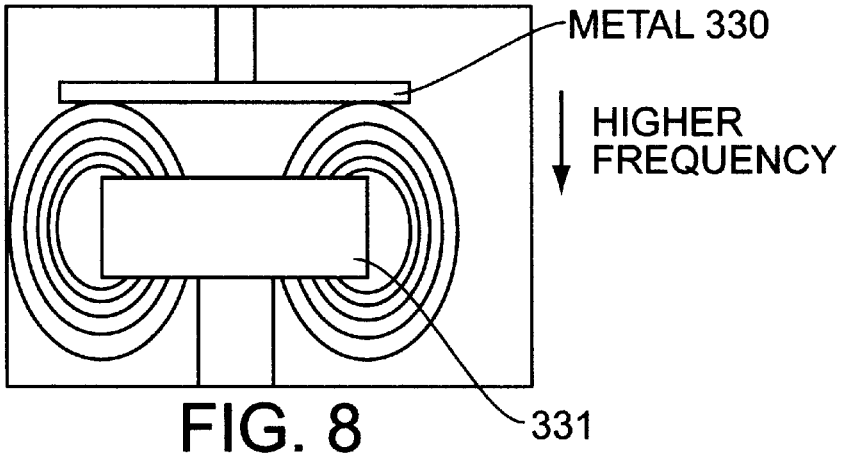
FIG. 8 PRIOR ART
FIG. 8 illustrates a conventional dielectric loaded wave guide cavity.

The design parameters as shown in FIG. 2 are specified such that if a single puck 361 were used, the single puck is specified such that it operates at a slightly lower frequency to the desired frequency of, for example, 1700 megahertz. The single puck may then be divided in half to provide the size of the two opposing pucks 371, 372. Thus, standard design calculations may be utilized to determine the approximate size of the pucks in order to get the lower range of the desired frequency of the bandpass filter. Splitting the pucks into two pucks of approximately equal size makes the puck appear as if it were larger. Accordingly, it is often desirable to utilize two pucks which, when combined, may equal approximately 107% of the size of a single puck had only a single puck been utilized. Using this approximation, it is possible to use standard software and/or calculations to determine the desired size of the two opposed pucks for the present invention.

Figure 3:
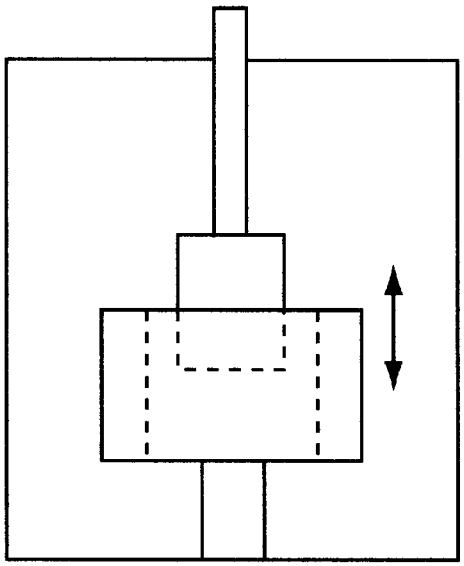
FIG. 3 illustrates an exemplary embodiment of one or more aspects of the present invention where two pucks are moved relative to one another and yet one puck resides inside the other puck.

In exemplary embodiments, two disk shaped ceramic pucks of approximately equal size are utilized and provide excellent results. However, alternate embodiments of the invention may use different configurations. For example, different embodiments may utilize two pucks with alternate configurations such as different shapes and/or sizes. For example, FIG. 3 shows one exemplary embodiment where two pucks are moved relative to one another and yet one puck resides inside the other puck. This configuration also provides suitable results.

In the pucks of the present invention, the height to diameter ratio is non-conventional. The standard ratio is 0.35 to 0.45 (height divided by diameter). However, the pucks of the present invention were specially made and are approximately half the thickness of conventional pucks with the same diameter, and violate the industry standards for height to diameter ratios.

Further, although a single tunable cavity may be utilized to achieve a large tuning range in accordance with one or more aspects of the present invention, it was found that the shape factor of the bandpass filter, i.e., the difference in the bandwidth between 3 db and 40 db attenuation is improved with additional sections. However, empirical test results indicated that the addition of additional sections introduces a complex problem of being able to tune all of the sections simultaneously in order to consistently maintain the tunability of the filter over a larger range. For example, where the tuning of each of the filters is done via a tuning belt and/or a gear arrangement, it is often difficult to maintain the fine tuning required for the performance specifications of the present filter over a wide frequency range. Even where a stepper motor is utilized, it was found that the use of only a single motor to tune all of the filters produced unacceptable results where all of the cavities were mechanically linked together.

Figure 4:
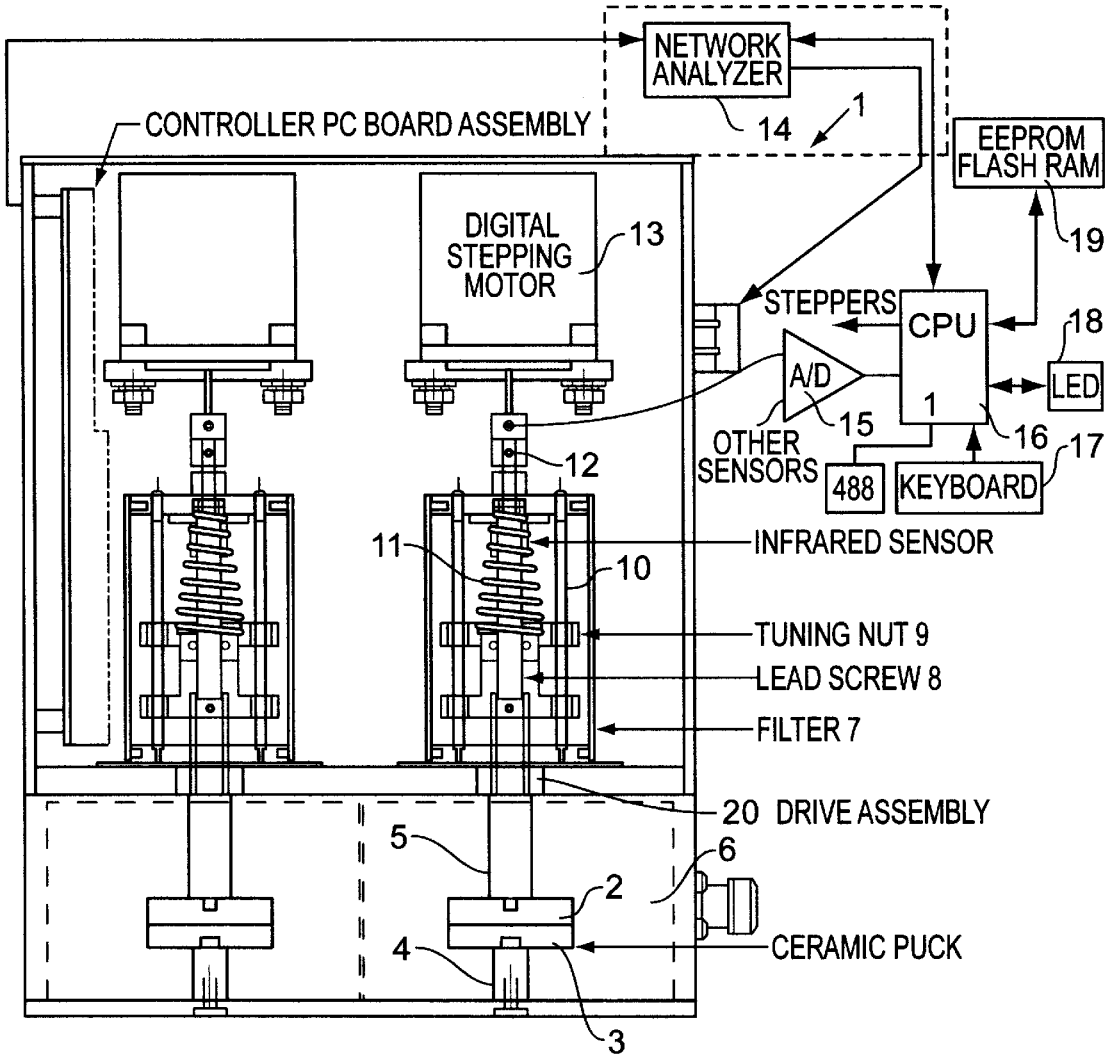
FIG. 4 illustrates an exemplary embodiment of one or more aspects of the present invention including a tuning mechanism having an electromechanical device which moves pucks relative to one another.
Figure 5:
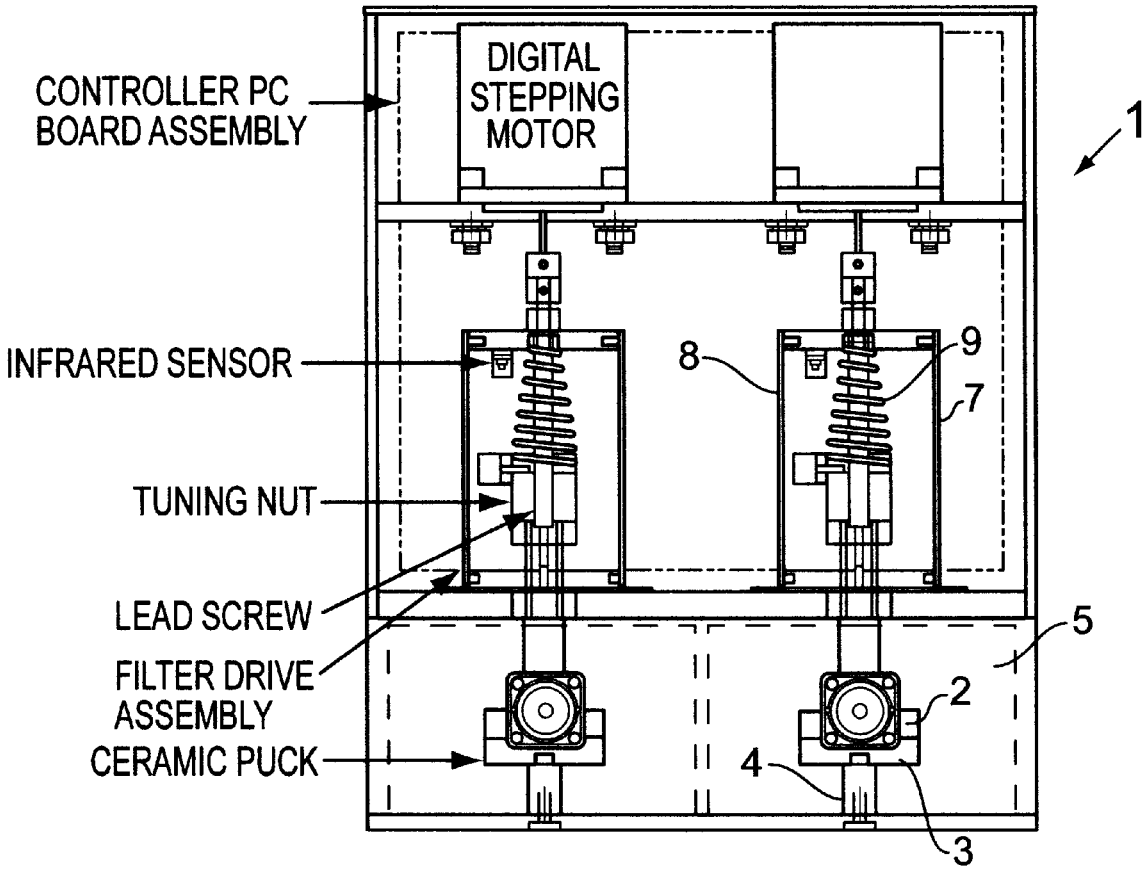
FIG. 5 illustrates a side view of the exemplary embodiment of FIG. 4.
Figure 6:
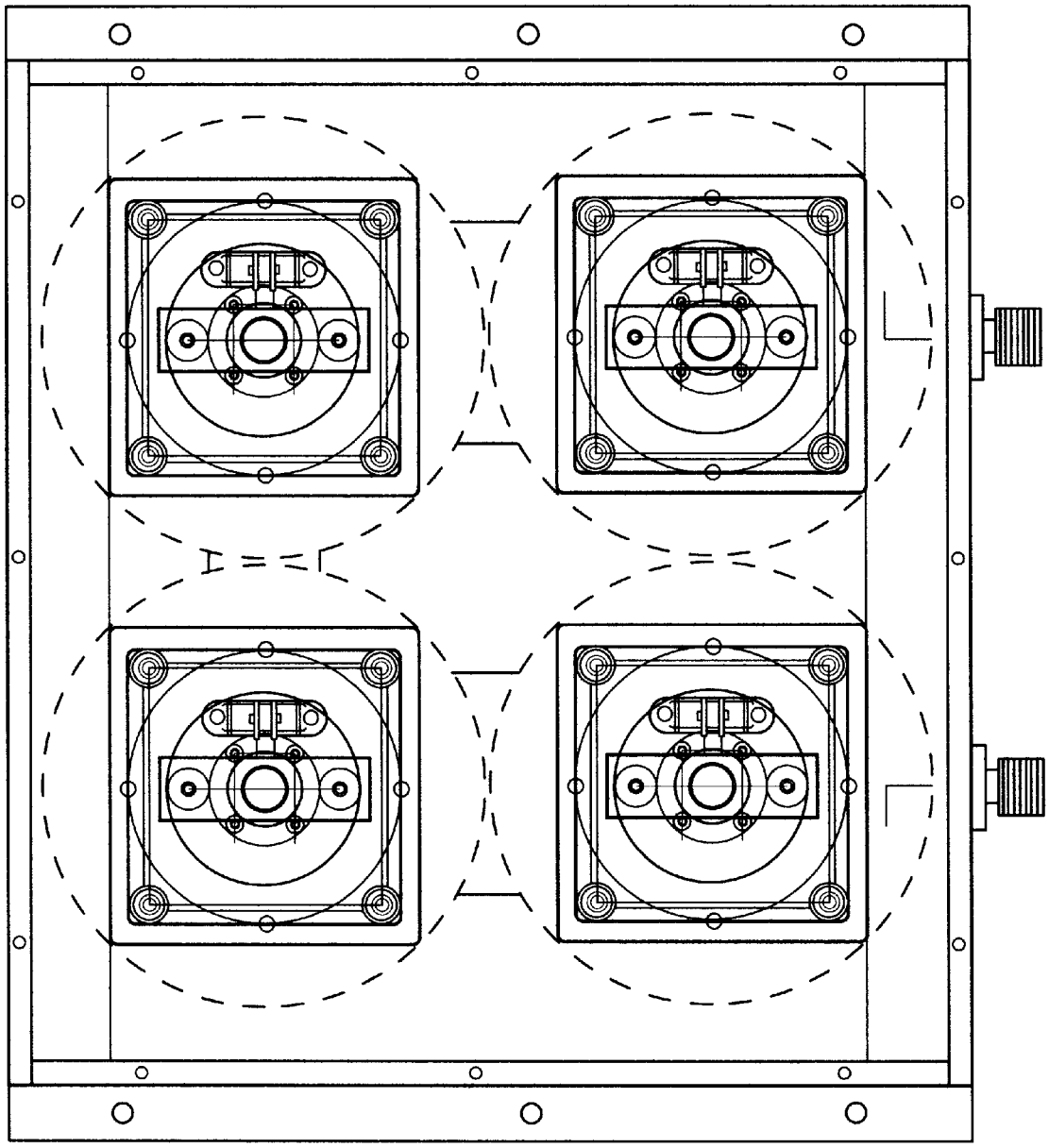
FIG. 6 illustrates a top view of the exemplary embodiment of FIG. 4.
Figure 7:
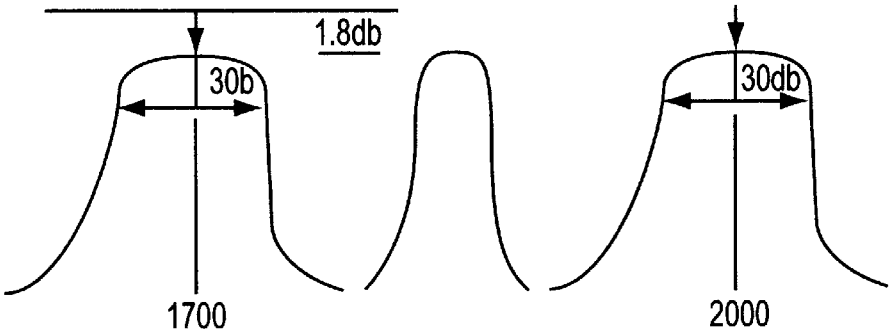
FIG. 7 PRIOR ART
FIG. 7 illustrates the bandpass characteristics of a typical conventional constant percent bandpass filter.
Figure 9:
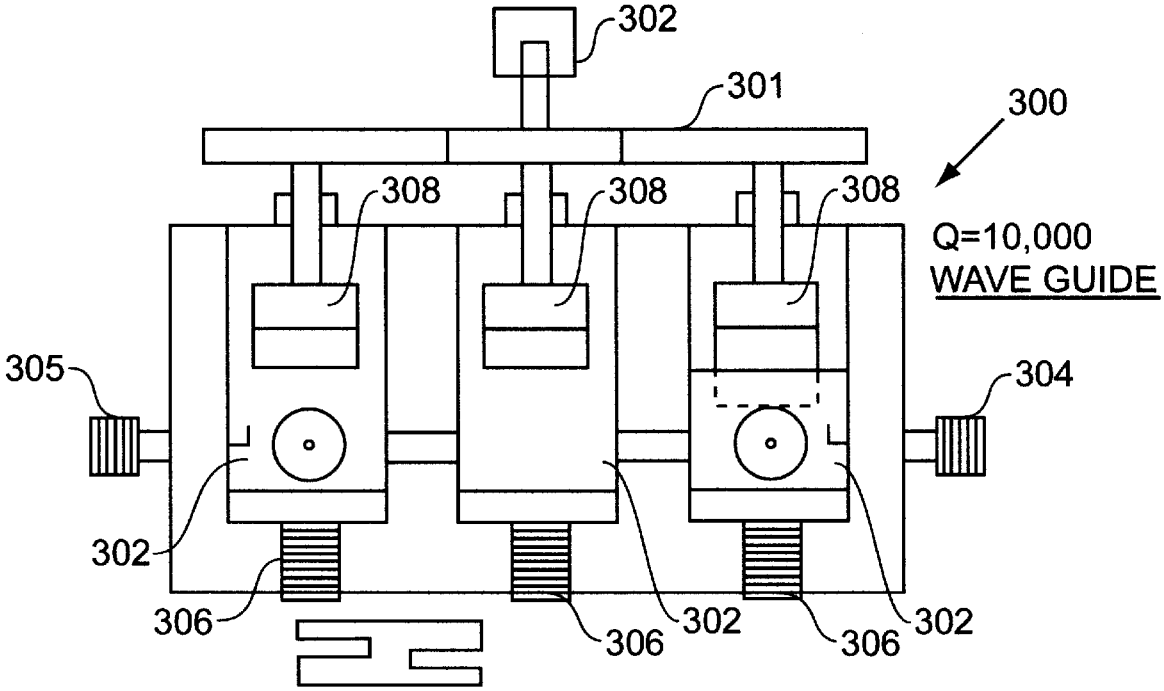
FIG. 9 PRIOR ART
FIG. 9 illustrates a conventional tunable filter.
Figure 10:
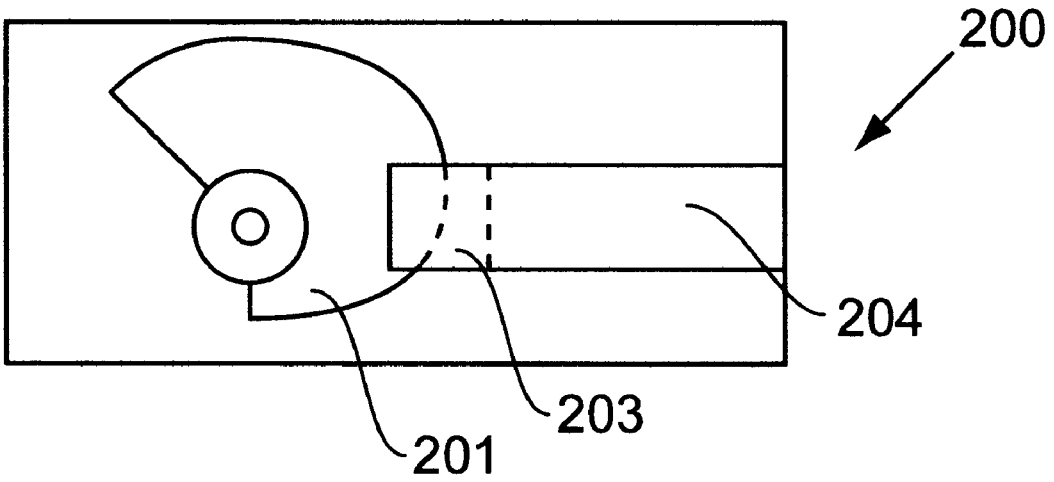
FIG. 10 PRIOR ART
FIG. 10 illustrates a conventional tunable filter.
Figure 11:
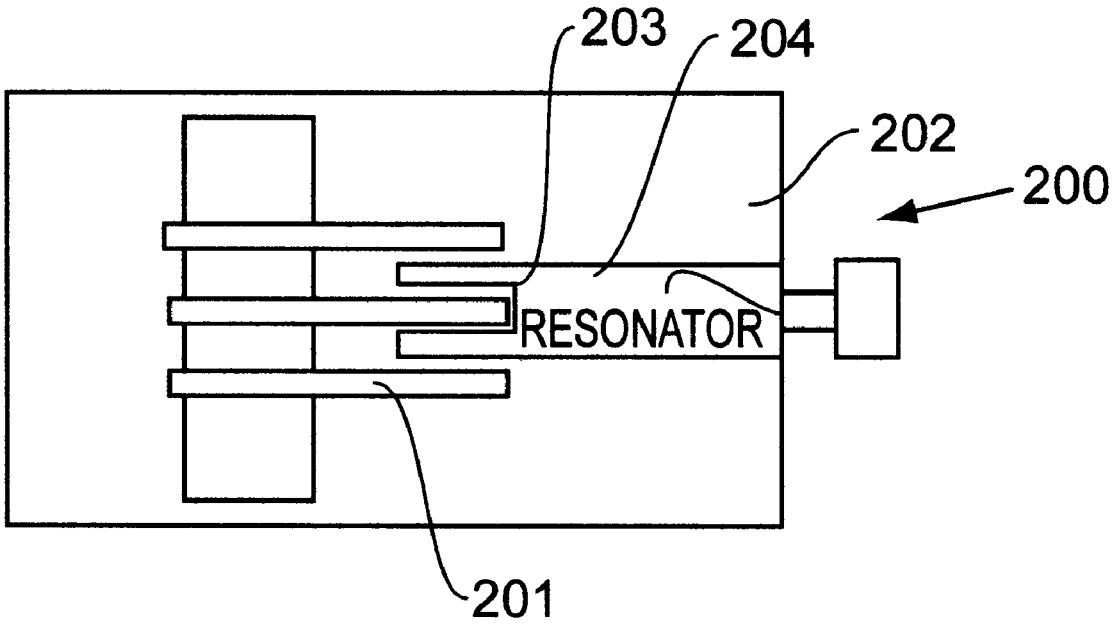
FIG. 11 PRIOR ART
FIG. 11 illustrates a conventional tunable filter.

However, this problem may be solved by using a new tuning mechanism. Referring to FIGS. 4–6, it was found that a tuning mechanism that includes an electromechanical device which moves the pucks relative to one another electronically based on a particular control algorithm produces excellent results. In the illustrated embodiment, the tuning puck may be controlled with an arrangement of a stepper motor which rotates a shaft through the top of the wave guide cavity and thus moves the tuning puck up and down.

The stepper motor arrangement shown in FIG. 4 has each of the cavities being independently controllable by a separate stepper motor. Additionally, even better results may be achieved where the puck that is movable relative to the other puck does not turn. The turning causes additional variations in the tuning of the filter and thus is undesirable. Accordingly, it is superior to move the upper puck up and down without turning the upper puck.

Referring specifically to FIG. 4, a standoff such as a Lexan or other standoff 4 may be utilized to support for example a fixed location puck 3. Additionally, it may be desirable to have a separate puck 2 which is movable with respect to puck 3 in the vertical direction. The separate puck 2 is preferably movable in the vertical direction with the puck 3 in a non-rotational manner. For example, if the puck 2 rotates with respect to puck 3 as the filter is tuned, deformities and/or non-uniformities in the base of the pucks affect the particular dielectric loading of the resonant wave guide. Thus, it is desirable to move the puck 2 relative to the puck 3 in a non-rotational manner.

A second stand-off or shaft 5 may be utilized to support the second puck 2 and is preferably positioned within a sleeve 20 to prevent the stand-off 5 from being skewed to one direction or another. Additionally, a tuning nut or carrier block 9 may slide up and down on support 10 such that the tuning nut is prevented from moving from side to side and hence the standoff 5 is kept in perfect vertical alignment. Additionally, slop within the tuning nut 9 may be prevented by use of spring 11 and lead screw 8 which may have a precision thread. For example, it is preferable that the tuning nut 9 and the lead screw 8 are precision cut to have, for example, 28 threads per inch, or 32 threads per inch, or even a higher thread count and may be precision manufactured on a lathe and custom fit together so that they have very close tolerance such as, for example, only a few ten thousandths of an inch of slop in between the screw and the tuning nut. Additionally, spring 11 helps to prevent slop of the tuning nut by keeping the tuning nut pushed against the lead screw such that the variation is minimized.

Additionally, an infrared sensor may be utilized to provide an index point or a common location upon which the stepper motor may be able to determine the exact positioning of the ceramic disk 2 and to reposition the ceramic disk 2 in the exact location at which it was previously located.

The wave guide filter 1 may optionally be coupled to a plurality of digital stepper motors 13 such that each of the individual movable disks 2 are separately and/or jointly controllable by the stepper motor 13. Where a plurality of stepper motors are utilized to provide increased precision, it may be desirable to control each of the stepper motors separately. However, where a single stepper motor is utilized, a gear or other belt type arrangement, such as a timing belt, may be utilized to couple all of the ceramic disks 2 together so that they are tuned in and out simultaneously through the use of a single stepper motor. However, for some applications of the present invention, it is difficult to obtain the high level of accuracy necessary for some types of filters using a single stepper motor. Accordingly, it may be desirable to use a plurality of stepper motors each controlling a separate lead screw 8 and each controlling separately tunable and movable ceramic pucks 2.

One exemplary embodiment uses a network analyzer 14 that may include a frequency sweep generator and a frequency analyzer (also not shown) to stimulate the wave guide cavity filter 1, to record the output of the wave guide cavity filter, and to feedback this information to CPU 16. The network analyzer 14 may optionally be controlled by CPU 16 and/or may have a separate control arrangement. In an exemplary embodiment, the control of the resonant wave guide cavity filter 1 may be accomplished by obtaining an index from sensor 12 by using A/D converter 15 and/or any other comparison circuitry into CPU 16. In most preferred embodiments, an A/D converter is utilized because it is possible to determine the point where the lead screw 8 is currently positioned by looking at the A/D converter and making a determination of the position by examining the current level of the output of the A/D.

In some embodiments, it may be desirable to place a window such that the AID converter in the sensor should preferably be configured to always receive a signal that is neither at the maximum nor at the minimum such that a determination may be made that the sensor in the A/D converter is currently functional. The A/D converter also provides a warning when the tuning screw or lead screw 8 approaches an extreme position at either end of the slide 10 such that the digital stepper motor 13 is not over torqued and burned up.

The CPU 16 may receive a signal of an index to determine the current position of the digital stepper motor and/or may move the lead screw 8 through the tuning nut 9 to establish an index position. Thereafter, movement of the digital stepper motor up and down may be recorded by CPU 16 such that the exact repeatable position of the ceramic disk 2 may be repeated. The CPU 16 may then establish reference ceramic wave guide filter performance data by utilizing a network analyzer 14 and recording the exact position of each stepper motor to achieve a particular bandpass filter at a plurality of locations along the particular tunable range that the filter is expected to be operated.

Thereafter, steps in between the ranges selected and analyzed by CPU 16 may be determined by an interpolation algorithm located in CPU 16. Additionally, the steps measured and recorded by CPU 16 may be recorded in any suitable location such as EEPROM/Flash RAM 19 and/or stored in a PROM device and burned at the factory. Additionally, a keypad 17 and/or a display device such as an LED display 18 may be coupled to the CPU 16 such that the user in the field may reprogram the ceramic wave guide device to provide a bandpass filter at any frequency location along the spectrum.

Additionally, the CPU 16 may also contain an interface such as an IEEE 488 interface and/or a serial, parallel, or custom interface, an RS 232, an RS 422, a BCD, and/or other suitable interface for controlling the filter characteristics such that the CPU 16 may reestablish a predefined set of filter characteristics upon command. In this way, the filter may be custom set and/or dynamically varied for a testing situation or other environment by CPU 16 in response to external equipment or in response to an input at the keypad 17. The particular filter settings may be displayed on the LED display 18 and/or a liquid crystal device that may also be enhanced to provide a graphic curve showing the current filter characteristics that may be provided initially by network analyzer 14.

The filter drive assembly 7 may include an outer housing 13 that provides additional rigidity and structure to ensure that the disk 2 is tuned precisely. Although the filter drive assembly 7 is shown in a preferred embodiment, it may alternatively be configured in any suitable mechanism provided the second ceramic puck 2 is moved precisely away from the first ceramic puck 3. For example, and alternative embodiment may include a piezoelectric fine tuning mechanism which moves the puck by a small degree. If a piezoelectric or other fine tuning mechanism is utilized, the digital stepper motor may or may not be utilized. In some embodiments, it may be desirable to tune solely with a piezoelectric element such that the electricity applied to the piezoelectric element provides the adjustment necessary to tune the filter over a narrow and/or broad range. In this manner, the entire circuitry for the filter drive assembly is completely solid state so that there are no other moving parts other than the piezoelectric element. Thus the reliability is substantially enhanced and the fine machining necessary to produce the part is not required.

Another filter drive assembly that may be suitable for the current application is the use of a linear drive motor, such as a linear drive motor controlled by a stepping motor which allows the second ceramic puck 2 to be moved up and down with extreme precision. The linear drive motor may be especially adapted for allowing a rough approximation to a particular location with either an optical sensor and/or a piezoelectric element utilized for providing the fine tuning once the ceramic puck is moved to a particular location. Where the digital stepper motor(s) are utilized in conjunction with a piezoelectric element, the digital stepper motor may be incremented at a much higher rate without the necessary incremental precision.

Each of the above elements, features, and methods may be utilized alone or in combination with the other elements to provide improved waveguide cavity filters. It will be apparent to one skilled in the art that the particular coupling between each of the resonant cavities may be any conventional coupling used in the industry. For example, the coupling may produce either a constant percent filter and/or a constant bandwidth filter over the entire tunable range as is well known in the art with current conventional aperture and other coupling techniques. Additionally, coupling techniques including either capacitive and/or inductive coupling may be utilized to couple up any of the cavities together in a conventional manner.

While exemplary systems and methods embodying the present invention are shown by way of example, it will be understood, of course, that the invention is not limited to these embodiments. Modifications may be made by those skilled in the art, particularly in light of the foregoing teachings. For example, each of the elements of the aforementioned embodiments may be utilized alone or in combination with elements of the other embodiments. Furthermore, it will be understood that while some examples of implementations are discussed above regarding the receiving components, the same principals, configurations and methods may be applied to transmitting circuitry. Accordingly, the appended claims are intended to cover all such alternate embodiments of the inventions.

What is claimed is:

1. A tunable dielectrically loaded waveguide cavity filter with an extended tuning range of at least 2 GHz comprising two opposed ceramic pucks.

2. The tunable dielectrically loaded waveguide cavity filter of claim 1 wherein each of the two opposed ceramic pucks have a height to diameter ratio of approximately 0.175 to approximately 0.225.

3. The tunable dielectrically loaded waveguide cavity filter of claim 1 wherein one of the two opposed ceramic pucks is disposed inside the other.

4. The tunable dielectrically loaded waveguide cavity filter of claim 1, wherein the tuning range is at least 15 GHz.

5. The tunable dielectrically loaded waveguide cavity filter of claim 1, wherein the two opposed ceramic pucks have a substantially similar height and diameter.

6. A tunable dielectrically loaded waveguide cavity filter comprising:

a waveguide cavity;

a rotatable shaft;

a movable ceramic puck within the waveguide cavity and coupled to the shaft, the puck moving linearly and without rotation within the waveguide cavity in response to rotation of the shaft;

a screw coupled to the shaft such that the screw rotates with the shaft; and a nut coupled to the screw and the ceramic puck such that the nut moves linearly along the screw in response to rotation of the screw, the ceramic puck moving linearly with linear movement of the nut.

7. The tunable dielectrically loaded waveguide cavity filter of claim 6, further including a stationary ceramic puck, the moveable ceramic puck being disposed at least partially inside the stationary ceramic puck.

8. The tunable dielectrically loaded waveguide cavity filter of claim 6, further including a spring for applying a force against the screw to reduce slop.

9. The tunable dielectrically loaded waveguide cavity filter of claim 6, further including a support slideably coupled to the nut, wherein the nut slides linearly along the support in response to the rotation of the screw.

10. The tunable dielectrically loaded waveguide cavity filter of claim 6, further including an elongated, standoff coupled to the ceramic puck and the nut for connecting the nut to the ceramic puck.

11. The tunable dielectrically loaded waveguide cavity filter of claim 6, further including a motor coupled to the shaft for rotating the shaft.

12. The tunable dielectrically loaded waveguide cavity filter of claim 11, wherein the motor is a stepper motor.

13. A tunable dielectrically loaded waveguide cavity filter comprising:

a plurality of cavities coupled in series, each cavity having a pair of opposed ceramic resonators disposed therein, at least one of the resonators being moveable; and a plurality of stepper motors each coupled to a different one of the ceramic resonators that are moveable and each configured to move the respective ceramic resonator that is moveable.

14. A tunable dielectrically loaded waveguide cavity filter having a cavity, a ceramic puck disposed in the cavity, and a graphical display for graphing a bandpass frequency characteristic of the tunable filter.

15. A tunable dielectrically loaded waveguide cavity filter comprising:

a cavity;

a ceramic puck disposed in the cavity;

a shaft coupling a stepper motor with the ceramic puck; and a sensor at least partially disposed on the shaft and configured to sense a position of the shaft, thereby determining a position of the puck within the cavity.

16. A method for tuning a dielectrically loaded waveguide cavity filter, the method comprising the steps of:

tuning the filter to a first frequency by moving at least one of two opposed ceramic pucks within a cavity of the filter; and tuning the filter to a second frequency at least 2 GHz away from the first frequency by moving the at least one ceramic puck within the cavity of the filter.

17. The method of claim 16, wherein the step of tuning the filter to the second frequency includes tuning the filter to a frequency at least 15 GHz away from the first frequency by moving the at least one ceramic puck within the cavity of the filter.

18. A tunable dielectrically loaded waveguide cavity filter comprising:

a plurality of waveguide cavities coupled in series, each of the cavities including a pair of opposed ceramic pucks disposed within the cavity; and a plurality of stepper motors, the stepper motors each being coupled to one of the ceramic pucks for moving the respective ceramic pucks within the respective cavities.

19. The tunable dielectrically loaded waveguide cavity filter of clam 18, wherein the plurality of stepper motors are each coupled to the respective ceramic pucks such that the respective ceramic pucks move within the respective cavities without rotation.

20. The tunable dielectrically loaded waveguide cavity filter of claim 18, wherein the plurality of cavities includes four cavities.

21. The tunable dielectrically loaded waveguide cavity filter of claim 18, further including a sensor configured to determine whether at least one of the ceramic pucks is located at an extreme position within the respective cavity.

* * * * *